US010276148B2

(12) United States Patent
Fleizach et al.

(10) Patent No.: US 10,276,148 B2
(45) Date of Patent: Apr. 30, 2019

(54) ASSISTED MEDIA PRESENTATION

(75) Inventors: Christopher B. Fleizach, Santa Clara, CA (US); Reginald Dean Hudson, San Francisco, CA (US); Eric Taylor Seymour, San Jose, CA (US)

(73) Assignee: APPLE INC., Cupertino, CA (US)

( * ) Notice: Subject to any disclaimer, the term of this patent is extended or adjusted under 35 U.S.C. 154(b) by 1153 days.

(21) Appl. No.: 12/939,940

(22) Filed: Nov. 4, 2010

(65) Prior Publication Data

US 2012/0116778 A1 May 10, 2012

(51) Int. Cl.
*G10L 13/033* (2013.01)

(52) U.S. Cl.
CPC ..... *G10L 13/0335* (2013.01)

(58) Field of Classification Search
CPC ..... G09B 21/00; G09B 21/006; G09B 21/008
USPC ..... 704/271, 258–269
See application file for complete search history.

(56) References Cited

U.S. PATENT DOCUMENTS 5,461,399 A 10/1995 Cragun
5,983,181 A * 11/1999 Yamazaki ..... 704/260
6,442,523 B1 * 8/2002 Siegel ..... 704/270
7,267,281 B2 * 9/2007 Hopkins ..... A61H 3/061 135/911
7,369,951 B2 * 5/2008 Blosser ..... G01S 17/026 434/112
7,454,000 B1 * 11/2008 Henderson ..... H04M 1/576 340/7.56
7,765,496 B2 * 7/2010 Bernstein ..... 715/865
8,060,082 B2 11/2011 Monte et al.
2003/0020671 A1 * 1/2003 Santoro et al. ..... 345/1.3
2003/0105639 A1 * 6/2003 Naimpally et al. ..... 704/276
(Continued)

FOREIGN PATENT DOCUMENTS

WO WO 2011/145788 11/2011

OTHER PUBLICATIONS

Microsoft, Step by Step Tutorials for Microsoft Windows 2000 Accessibility Options, Copyright 2004 Retrieved via web at http://download.microsoft.com/download/b/d/5/bd515214-0728-4a54-9625-ab3f198cf448/Windows2000.doc on Feb. 27, 2014.*
(Continued)

*Primary Examiner* — Michael N Opsasnick
(74) *Attorney, Agent, or Firm* — Fernando & Partners, LLP; Jacob A. Smith

(57) ABSTRACT

Some examples of assisted media representation can be implemented as a system and method that uses screen reader like functionality to speak information presented on a graphical user interface displayed by a media presentation system, including information that is not navigable by a remote control device. Information can be spoken in an order that follows a relative importance of the information based on a characteristic of the information or the location of the information within the graphical user interface. A history of previously spoken information is monitored to avoid speaking information more than once for a given graphical user interface. A different pitch can be used to speak information based on a characteristic of the information. Information that is not navigable by the remote control device can be spoken after time delay. Voice prompts can be provided for a remote-driven virtual keyboard displayed by the media presentation system. The voice prompts can be spoken with different voice pitches.

27 Claims, 8 Drawing Sheets

(56) References Cited

U.S. PATENT DOCUMENTS

| | | | | |
|---|---|---|---|---|
| 2004/0218451 | A1 | 11/2004 | Said et al. | |
| 2005/0041014 | A1* | 2/2005 | Slotznick | 345/156 |
| 2005/0041793 | A1* | 2/2005 | Fulton | H04M 3/42263 379/211.01 |
| 2005/0092835 | A1* | 5/2005 | Chung et al. | 235/386 |
| 2005/0149870 | A1* | 7/2005 | Van Ee et al. | 715/700 |
| 2006/0080034 | A1* | 4/2006 | Hayashi | 701/211 |
| 2006/0105301 | A1* | 5/2006 | Chriss | G06F 19/3418 434/112 |
| 2007/0208687 | A1* | 9/2007 | O'Conor et al. | 707/1 |
| 2008/0086303 | A1* | 4/2008 | Sengamedu | 704/231 |
| 2008/0229206 | A1 | 9/2008 | Seymour et al. | |
| 2008/0244654 | A1* | 10/2008 | Angiolillo | 725/42 |
| 2009/0055186 | A1* | 2/2009 | Lance et al. | 704/260 |
| 2009/0083635 | A1* | 3/2009 | Alderson | G06F 9/451 715/746 |
| 2009/0141905 | A1 | 6/2009 | Warhol | |
| 2009/0187950 | A1* | 7/2009 | Nicas et al. | 725/56 |
| 2009/0259473 | A1* | 10/2009 | Chang et al. | 704/260 |
| 2010/0070872 | A1* | 3/2010 | Trujillo | 715/745 |
| 2010/0134416 | A1 | 6/2010 | Karasin et al. | |
| 2010/0199215 | A1* | 8/2010 | Seymour et al. | 715/808 |
| 2012/0323578 | A1* | 12/2012 | Kubota | 704/260 |
| 2013/0042180 | A1* | 2/2013 | Sai et al. | 715/729 |

OTHER PUBLICATIONS

Chen, Xiaoyu, et al., "AudioBrowser: a mobile browsable information access for the visually impaired," Universal Access in the Information Society5. Jan. 1, 2006: 4-22. Source: ProQuest Technology Collection.

* cited by examiner

ASSISTED MEDIA PRESENTATION

TECHNICAL FIELD

This disclosure relates generally to accessibility applications for assisting visually impaired users to navigate graphical user interfaces.

BACKGROUND

A digital media receiver (DMR) is a home entertainment device that can connect to a home network to retrieve digital media files (e.g., music, pictures, video) from a personal computer or other networked media server and play them back on a home theater system or television. Users can access the content stores directly through the DMR to rent movies and TV shows and stream audio and video podcasts. A DMR also allows a user to sync or stream photos, music and videos from their personal computer and to maintain a central home media library.

Despite the availability of large high definition television screens and computer monitors, visually impaired users may find it difficult to track a cursor on the screen while navigating with a remote control device. Visual enhancement of on screen information may not be helpful for screens with high density content or where some content is not navigable by the remote control device.

SUMMARY

A system and method is disclosed that uses screen reader like functionality to speak information presented on a graphical user interface displayed by a media presentation system, including information that is not navigable by a remote control device. Information can be spoken in an order that follows the relative importance of the information based on a characteristic of the information or the location of the information within the graphical user interface. A history of previously spoken information is monitored to avoid speaking information more than once for a given graphical user interface. A different pitch can be used to speak information based on a characteristic of the information. In one aspect, information that is not navigable by the remote control device is spoken after a time delay. Voice prompts can be provided for a remote-driven virtual keyboard displayed by the media presentation system. The voice prompts can be spoken with different voice pitches.

In some implementations, a graphical user interface is caused to be displayed by a media presentation system. Navigable and non-navigable information are identified on the graphical user interface. The navigable and non-navigable information are converted into speech. The speech is output in an order that follows the relative importance of the converted information based on a characteristic of the information or a location of the information within the graphical user interface.

In some implementations, a virtual keyboard is caused to be displayed by a media presentation system. An input is received from a remote control device selecting a key of the virtual keyboard. Speech corresponding to the selected key is outputted. The media presentation system can also cause to be displayed an input field. The current content of the input field can be spoken each time a new key is selected entering a character, number, symbol or command in the input field, allowing a user to detect errors in the input field.

Particular implementations disclosed herein can be implemented to realize one or more of the following advantages. Information within a graphical user interface displayed on a media presentation system is spoken according to its relative importance to other information within the graphical user interface, thereby orientating a vision impaired user navigating the graphical user interface. Non-navigable information is spoken after a delay to allow the user to hear the information without having to focus a cursor or other pointing device on each portion of the graphical user interface where there is information. A remote-driven virtual keyboard provides voice prompts to allow a vision impaired user to interact with the keyboard and to manage contents of an input field displayed with the virtual keyboard.

The details of one or more implementations of assisted media presentation are set forth in the accompanying drawings and the description below. Other features, aspects, and advantages will become apparent from the description, the drawings, and the claims.

BRIEF DESCRIPTION OF THE DRAWINGS

Like reference symbols in the various drawings indicate like elements.

DETAILED DESCRIPTION

Exemplary System For Presenting Spoken Interfaces

Figure 1:
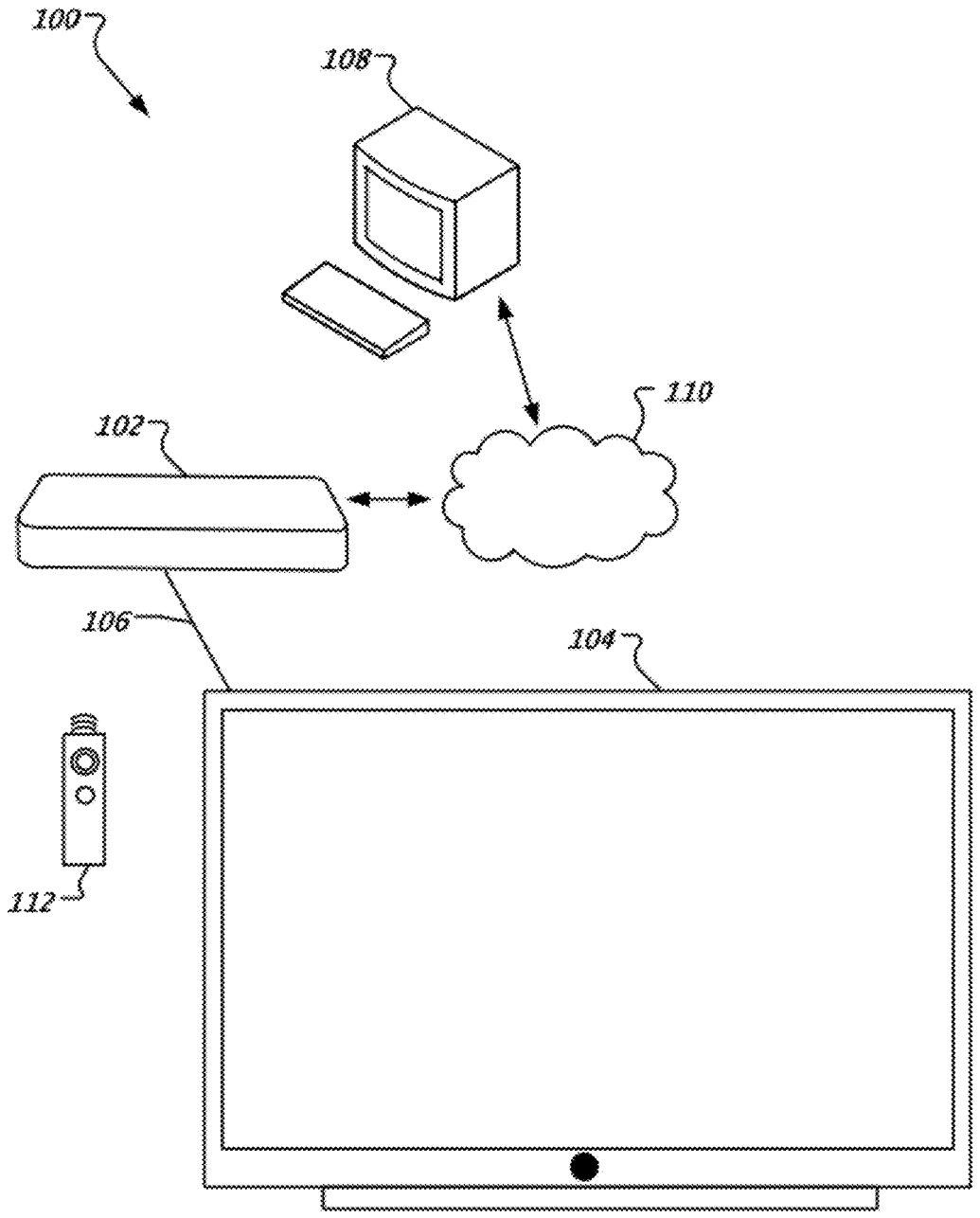
FIG. 1 is a block diagram of a system for presenting spoken interfaces.

FIG. 1 is a block diagram of a system 100 for presenting spoken interfaces. In some implementations, system 100 can include digital media receiver (DMR) 102, media presentation system 104 (e.g., a television) and remote control device 112. DMR 102 can communicate with media presentation system 104 through a wired or wireless communication link 106. DMR 102 can also couple to a network 110, such as a wireless local area network (WLAN) or a wide area network (e.g., the Internet). Data processing apparatus 108 can communicate with DMR 102 through network 110. Data processing apparatus 108 can be a personal computer, a smart phone, an electronic tablet or any other data processing apparatus capable of wired or wireless communication with another device or system.

An example of system 100 can be a home network that includes a wireless router for allowing communication between data processing apparatus 108 and DMR 102. Other example configurations are also possible. For example, DMR 102 can be integrated in media presentation system 104 or within a television set-top box. In the example shown, DMR 102 is a home entertainment device that can connect to home network to retrieve digital media files (e.g., music, pictures, or video) from a personal computer or other networked media server and play the media files back on a home theater system or TV. DMR 102 can connect to the home network using either a wireless (IEEE 802.11x) or wired (e.g., Ethernet) connection. DMR 102 can cause display of graphical user interfaces that allow users to navigate through a digital media library, search for, and play media files (e.g., movies, TV shows, music, podcasts).

Remote control device 112 can communicate with DMR 102 through a radio frequency or infrared communication link. As described in reference to FIGS. 2-5, remote control device 112 can be used by a visually impaired user to navigate spoken interfaces. Remote control device 112 can be a dedicated remote control, a universal remote control or any device capable of running a remote control application (e.g., a mobile phone, electronic tablet). Media presentation system 104 can be any display system capable of displaying digital media, including but not limited to a high-definition television, a flat panel display, a computer monitor, a projection device, etc.

Exemplary Spoken Interfaces

Figure 2A:
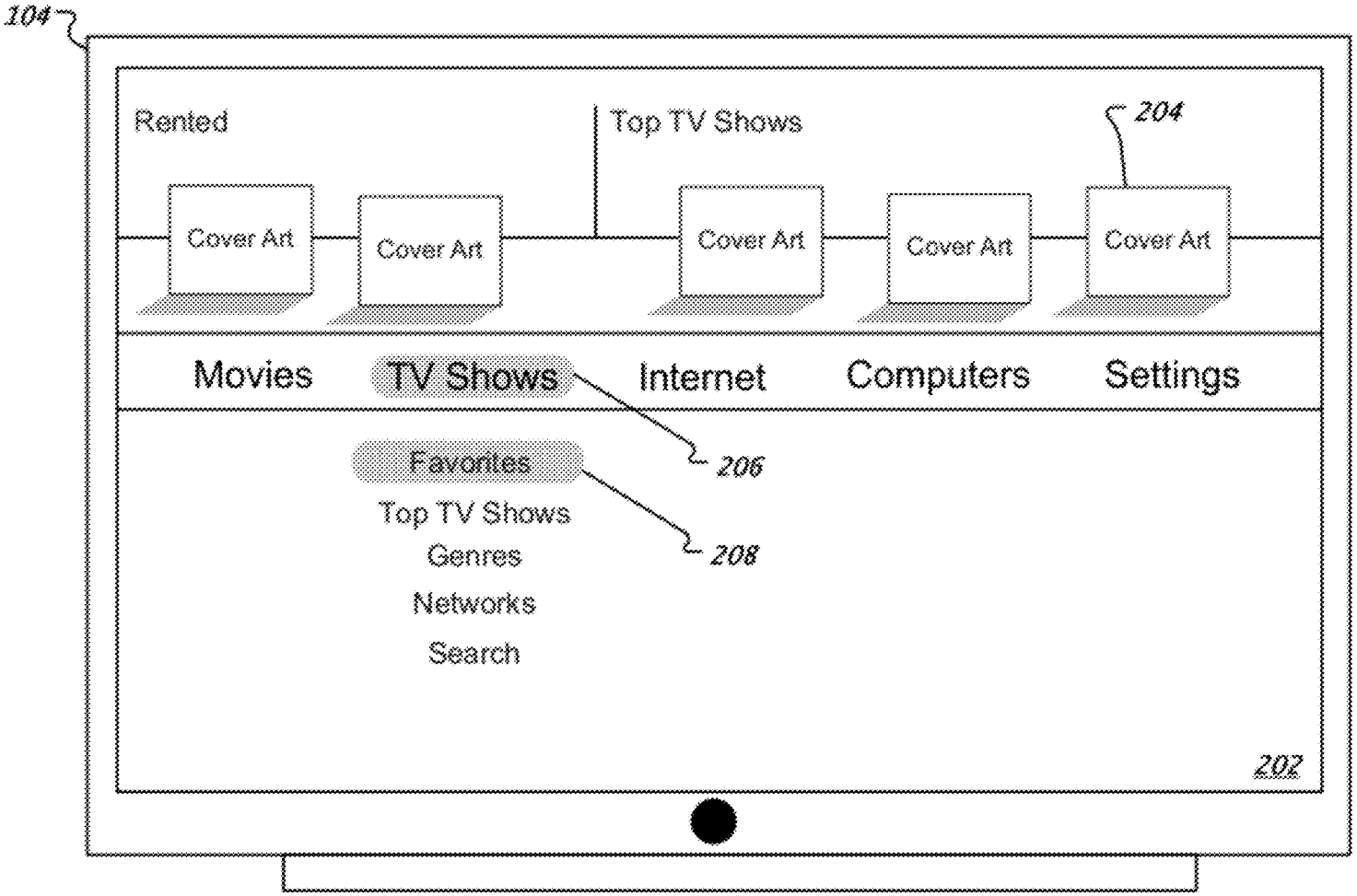
FIGS. 2A-2C illustrate exemplary spoken interfaces provided by the system of FIG. 1.
Figure 2B:
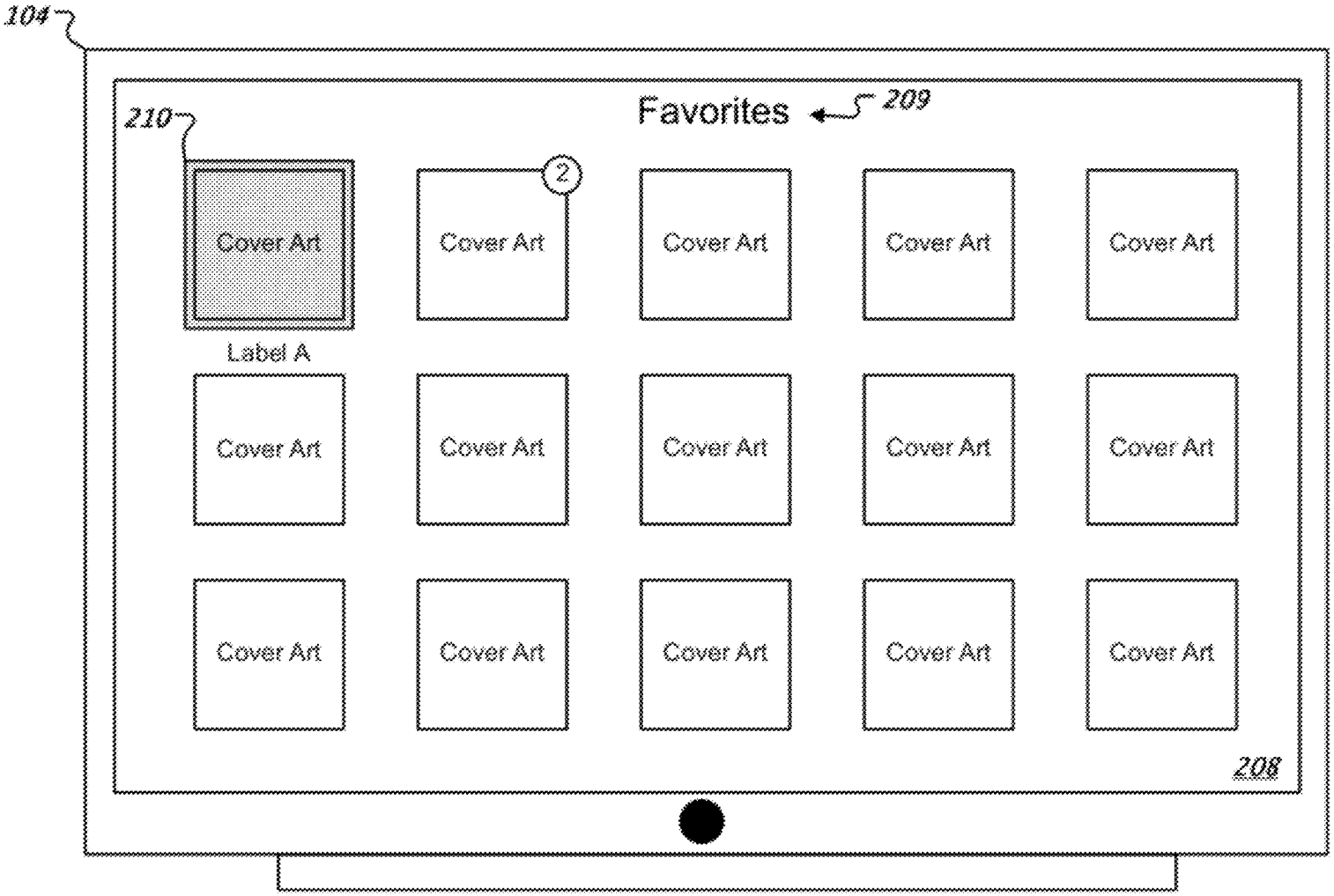
Figure 2C:
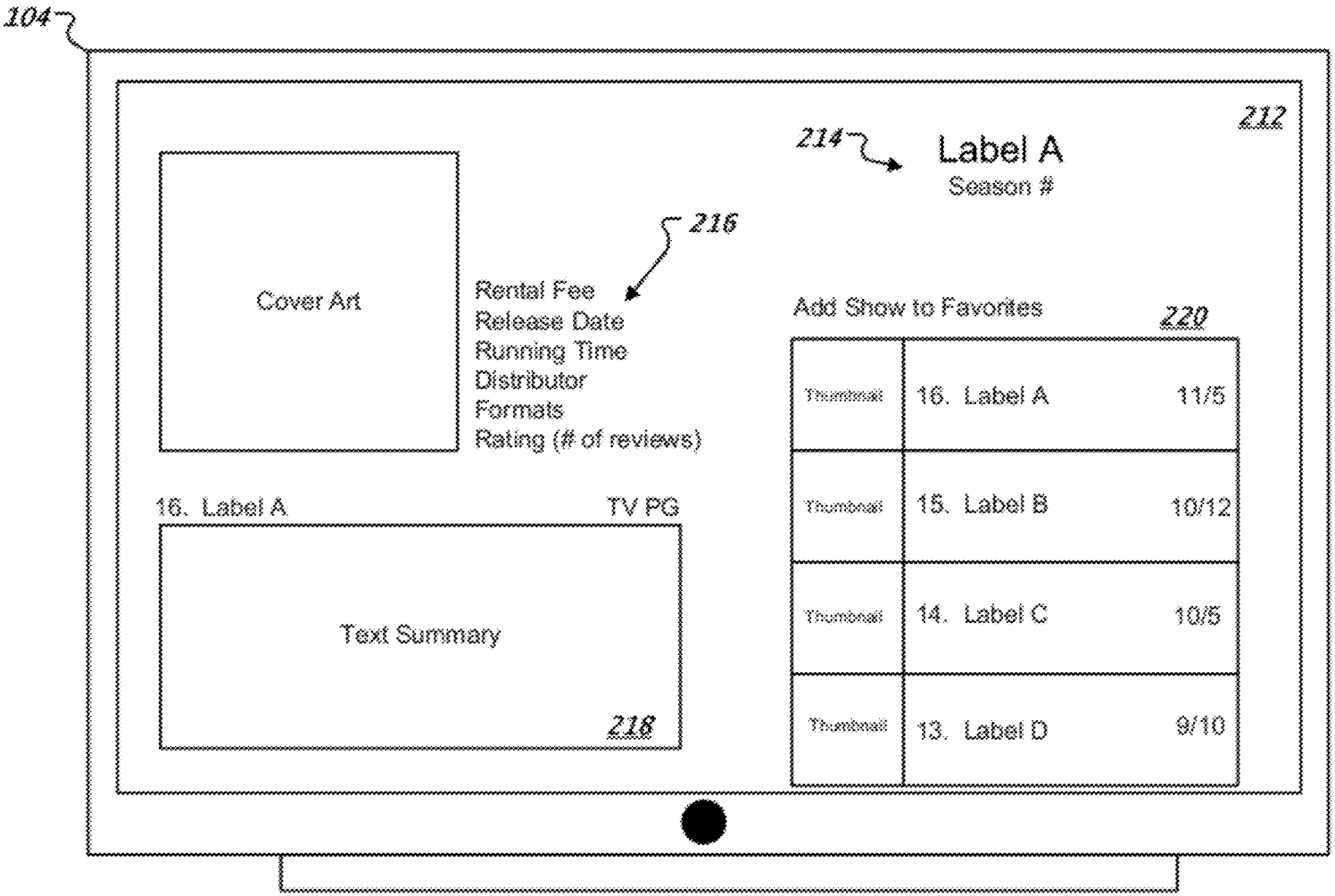

FIGS. 2A-2C illustrate exemplary spoken interfaces provided by the system of FIG. 1. Spoken interfaces include information (e.g., text) that can be read aloud by a text to speech (TTS) engine as part of a screen reader residing on DMR 102. In the example shown, the screen reader can include program code with Application Programming Interfaces (APIs) that allow application developers to access screen reading functionality. The screen reader can be part of an operating system running on DMR 102. In some implementations, the screen reader allows users to navigate graphical user interfaces displayed on media presentation system 104 by using a TTS engine and remote control device 112. The screen reader provides increased accessibility for blind and vision-impaired users and for users with dyslexia. The screen reader can read typed text and screen elements that are visible or focused. Also, it can present an alternative method of accessing the various screen elements by use of remote control device 112 or virtual keyboard. In some implementations, the screen reader can support Braille readers. An example screen reader is Apple Inc.'s VoiceOver™ screen reader included in Mac OS beginning with Mac OS version 10.4.

In some implementations, a TTS engine in the screen reader can convert raw text displayed on the screen containing symbols like numbers and abbreviations into an equivalent of written-out words using text normalization, pre-processing or tokenization. Phonetic transcriptions can be assigned to each word of the text. The text can then be divided and marked into prosodic units (e.g., phrases, clauses, sentences) using text-to-phoneme or grapheme-to-phoneme conversion to generate a symbolic linguistic representation of the text. A synthesizer can then convert the symbolic linguistic representation into sound, including computing target prosody (e.g., pitch contour, phoneme durations), which can be applied to the output speech. Some examples of synthesizers are concatenative synthesis, unit selection synthesis, diphone synthesis or any other known synthesis technology.

Referring to FIG. 2A, graphical user interface (GUI) 202 is displayed by media presentation system 104. In this example, GUI 202 can be a home screen of an entertainment center application showing digital media items that are available to the user. The top of GUI 202 includes cover art of top TV shows and rented TV shows. A menu bar below the cover art is a menu bar including category screen labels: Movies, TV Shows, Internet, Computer and Settings. Using remote control device 112, a user can select a screen label in the menu bar corresponding to a desired option. In the example shown, the user has selected screen label 206 corresponding to the TV Shows category, which caused a list of subcategories to be displayed: Favorites, Top TV Shows, Genres, Networks and Search. The user has selected screen label 208 corresponding to the Favorites subcategory.

The scenario described above works fine for a user with good vision. However, such a sequence may be difficult for vision impaired user who may be sitting a distance away from media presentation system 104. For such users, a screen reader mode can be activated.

In some implementations, a screen reader mode is activated when DMR 102 is initially installed and setup. A setup screen can be presented with various set up options, such as a language option. After a specified number of seconds of delay (e.g., 2.5 seconds), a voice prompt can request the user to operate remote control device 112 to activate the screen reader. For example, the voice prompt can request the user to press a Play or other button on remote control device 112 a specified number of times (e.g., 3 times). Upon receiving this input, DMR 102 can activate the screen reader. The screen reader mode can remain set until the user deactivates the mode in a settings menu.

When the user first enters GUI 202, a pointer (e.g., a cursor) can be focused on the first screen element in the menu bar (Movies) as a default entry point into GUI 202. Once in GUI 202, the screen reader can read through information displayed on GUI 202 in an order that follows a relative importance of the information based on a characteristic of the information or the location of the information within GUI 202.

The screen labels in the menu bar can be spoken from left to right. If the user selects category screen label 206, screen label 206 will be spoken as well as each screen label underneath screen label 206 from top to bottom. When the user focuses on a particular screen label, such as screen label 208 (Favorites subcategory), screen label 208 will be spoken after a few time period expires without a change in focus (e.g., 2.5 seconds).

Referring now to FIG. 2B, a GUI 208 is displayed in response to the user's selection of screen label 208. In this example, a grid view is shown with rows of cover art representing TV shows that the user has in a Favorites list. The user can use remote control device 112 to navigate horizontally in each row and navigate vertically between rows. When the user first enters GUI 208, screen label 209 is spoken and the focus default can be on the first item 210. Since this item is selected, the screen reader will speak the label for the item (Label A). As the user navigates the row from item to item, the screen reader will speak each item label in turn and any other context information associated with the label. For example, the item Label A can be a title and include other context information that can be spoken (e.g., running time, rating).

Since screen label 209 was already spoken when the user entered GUI 208, screen label 209 will not be spoken again, unless the user requests a reread. In some implementations, remote control device 112 can include a key, key sequence or button that causes information to be reread by the screen reader.

In some implementations, a history of spoken information is monitored in screen reader mode. When the user changes focus, the history can be reviewed to determine whether screen label 209 has been spoken. If screen label 209 has been spoken, screen label 209 will not be spoken again, unless the user requests that screen label 209 be read again. Alternatively, the user can back out of GUI 208, then re-enter GUI 208 again to cause the label to be read again.

In this example, screen label 209 is said to be an "ancestor" of Label A. Information that is the current focus of the user can be read and re-read. For example, if the user navigates left and right in row 1, each time an item becomes a focus the corresponding Label is read by the screen reader.

Referring now to FIG. 2C, a GUI 212 is displayed in response to the user's selection of item Label A in GUI 208. In this example, GUI 212 presents context information (e.g., details) about a particular TV show having Label A. GUI 212 is divided into sections or portions, where each portion includes information that can be spoken by the screen reader. In the example shown, GUI 212 includes screen label 214, basic context information 216, summary 218 and queue 220. At least some of the information displayed on GUI 212 can be non-navigable. As used herein, non-navigable information is information in a given GUI that the user cannot focus on using, for example, a screen pointer (e.g., a cursor) operated by a remote control device. In the example shown, screen label 214, basic information 216 and summary 218 are all non-navigable context information displayed on GUI 212. By contrast, the queue 220 is navigable in that the user can focus a screen pointer on an entry of queue 220, causing information in the entry to be spoken.

For GUIs that display non-navigable information, the screen reader can wait a predetermined period of time before speaking the non-navigable information. In the example shown, when the user first navigates to GUI 212, screen label 214 is spoken. If the user takes no further action in GUI 212, and after expiration of a predetermined period of time (e.g., 2.5 seconds), the non-navigable information (e.g., basic info 216, summary 218) can be spoken.

In some implementations, a different voice pitch can be used to speak different types of information. For example, context information (e.g., screen labels that categorizes content) can be spoken in a first voice pitch and content information (e.g., information that describes the content) can be spoken in a second voice pitch, where the first voice pitch is higher or lower than the second voice pitch. Also, the speed of the spoken speech and the gender of the voice can be selected by a user through a settings screen accessible through the menu bar of GUI 202.

Exemplary Remote-Drive Virtual Keyboard

Figure 3:
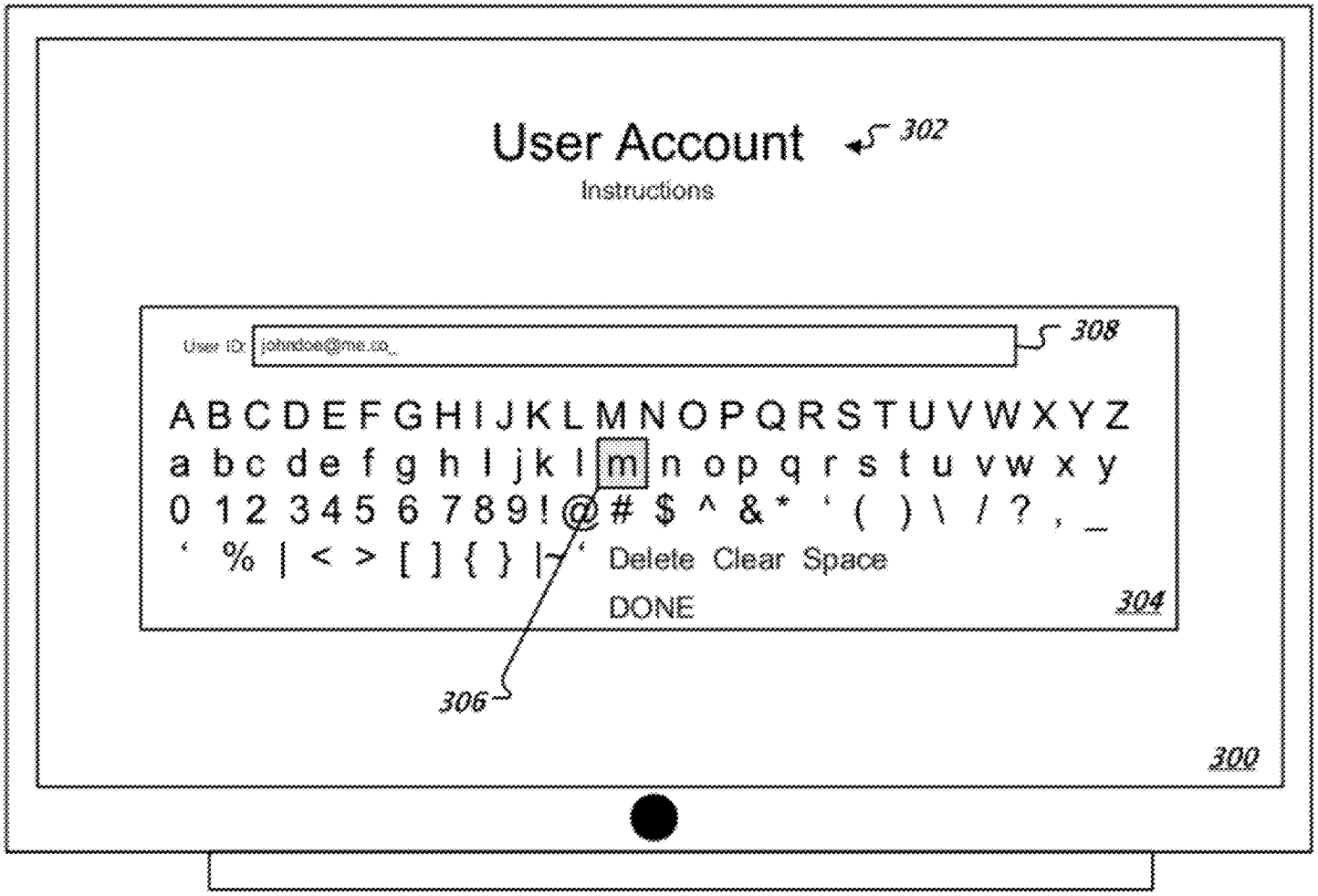
FIG. 3 illustrates voice prompts for a remote-driven virtual keyboard.

FIG. 3 illustrates voice prompts for a remote-driven virtual keyboard. In some implementations, GUI 300 can display virtual keyboard 304. Virtual keyboard 304 can be used to enter information that can be used by applications, such as user account information (e.g., user ID, password) to access an online content service provider. For vision impaired users operating remote control device 112, interacting with virtual keyboard 304 can be difficult. For such users, the screen reader can be used to speak the keys pressed by the user and also the text typed in text field 308.

In the example shown, the user has entered GUI 300 causing screen label 302 to be spoken, which comprises User Account and instructions for entering a User ID. The user has partially typed in a User ID (johndoe@me.co_) in input field 308 and is about to select the "m" key 306 on virtual keyboard 304 (indicated by an underscore) to complete the User ID entry in input field 308. When the user selects the "m" key 306, or any key on virtual keyboard 304, the screen reader speaks the character, number, symbol or command corresponding to the key. In some implementations, before speaking the character "m," the contents in input field 308 (johndoe@me.co_) are spoken first. This informs the vision impaired user of the current contents of input field 308 so the user can correct any errors. If a character is capitalized, the screen reader can speak the word "capital" before the character to be capitalized is spoken, such as "capital M." If a command is selected, such as Clear or Delete, the item to be deleted can be spoken first, followed by the command. For example, if the user deletes the character "m" from input field 308, then the TTS engine can speak "m deleted." In some implementations, when the user inserts a letter in input field 308, the phonetic representation (e.g., alpha, bravo, charlie) can be outputted to aid the user in distinguishing characters when speech is at high speed. If the user requests to clear input field 308 using remote control device 112 (e.g., by pressing a clear button), the entire contents of input field 308 will be spoken again to inform the user of what was deleted. In the above example, the phrase "johndoe@me.com deleted" would be spoken.

Exemplary Processes

Figure 4:
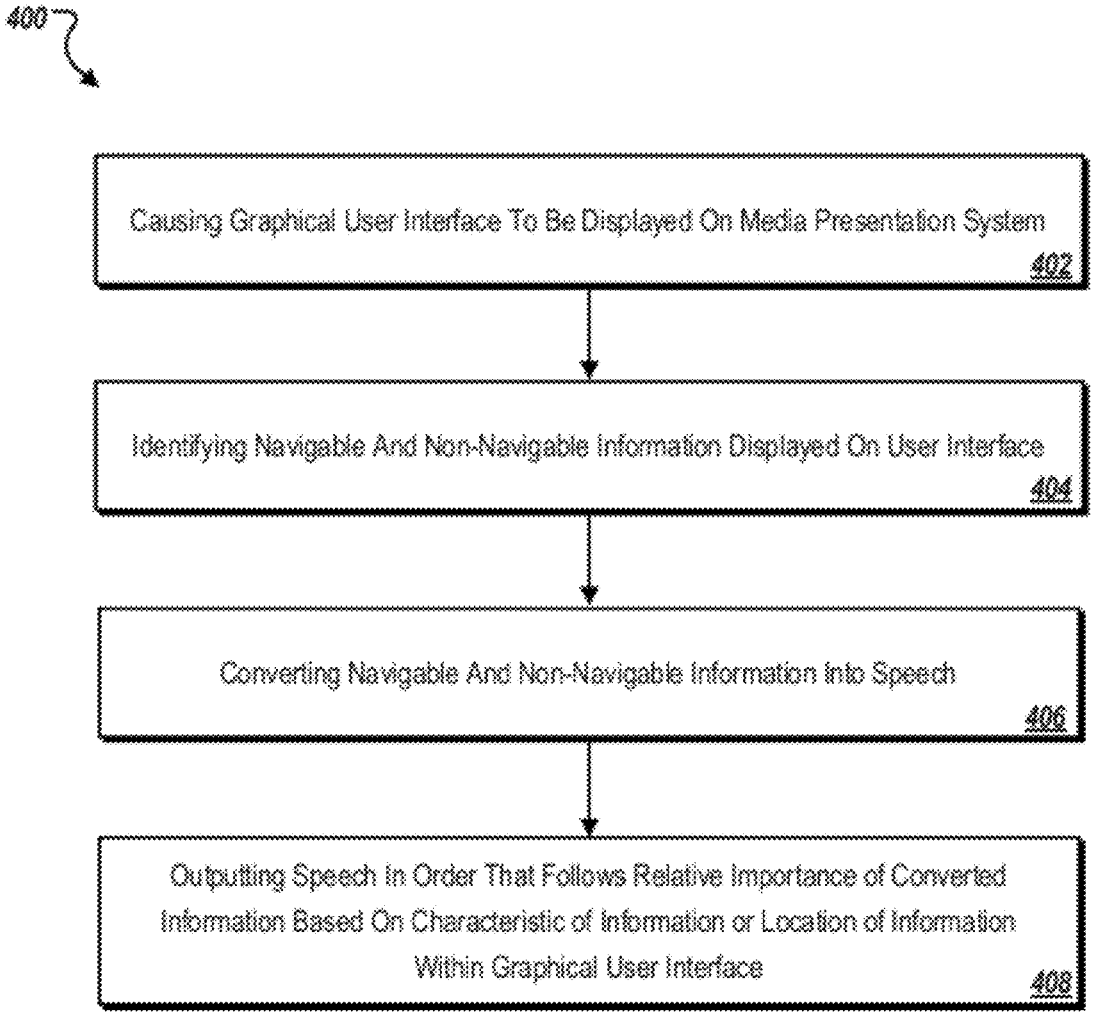
FIG. 4 is a flow diagram of an exemplary process for providing spoken interfaces.

FIG. 4 is a flow diagram of an exemplary process 400 for providing spoken interfaces. All or part of process 400 can be implemented in, for example, DMR 600 as described in reference to FIG. 6. Process 400 can be one or more processing threads run on one or more processors or processing cores. Portions of process 400 can be performed on more than one device.

In some implementations, process 400 can begin by causing a GUI to be displayed on a media presentation system (402). Some example GUIs are GUIs 202, 208 and 212. An example media presentation system is a television system or computer system with display capability. Process 400 identifies navigable and non-navigable information displayed on the graphical user interface (404). Process 400 converts navigable and non-navigable information into speech (406). For example, a screen reader with a TTS engine can be used to convert context information and content information in the GUI to speech. Process 400 outputs speech in an order that follows a relative importance of the converted information based on a characteristic of the information or the location of information on the graphical user interface (408). Examples of characteristics can include the type of information (e.g., context related or content related), whether the information is navigable or not navigable, whether the information is a sentence, word or phoneme, etc. For example, a navigable screen label may be spoken before a non-navigable content summary for a given GUI of information. In some implementations, a history of spoken information can be monitored to ensure that information previously spoken for a given GUI is not spoken again, unless requested by the user. In some implementations, a time delay (e.g., 2.5 seconds) can be introduced prior to speaking non-navigable information. In some implementations, information can be spoken with different voice pitches based on characteristics of the information. For example, a navigable screen label can be spoken with a first voice pitch and a non-navigable text summary can be spoken with a second pitch higher or lower than the first pitch.

Figure 5:
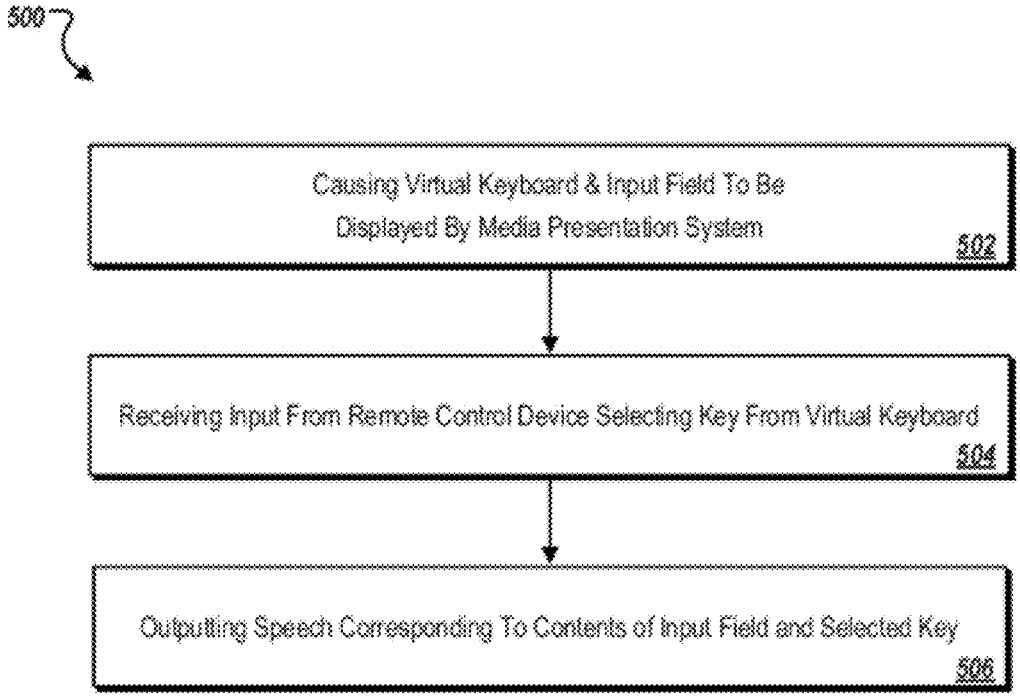
FIG. 5 is a flow diagram of an exemplary process for providing voice prompts for a remote-driven virtual keyboard.

FIG. 5 is a flow diagram of an exemplary process 500 for providing voice prompts for a remote-driven virtual keyboard (e.g., virtual keyboard 304). All or part of process 500 can be implemented in, for example, DMR 600 as described in reference to FIG. 6. Process 500 can be one or more processing threads run on one or more processors or processing cores. Portions of process 500 can be performed on more than one device.

Process 500 can begin by causing a virtual keyboard to be displayed on a media presentation system (502). An example GUI is GUI 300. An example media presentation system is a television system or computer system with display capability. Process 500 can then receive input from a remote control device (e.g., remote control device 112) selecting a key on the virtual keyboard (504). Process 500 can then use a TTS engine to output speech corresponding to the selected key (506).

In some implementations, the TTS engine can speak using a voice pitch based on the selected key or phonetics. In some implementations, process 500 can cause an input field to be displayed by the media presentation system and content of the input field to be output as speech in a continuous manner. After the contents are spoken, process 500 can cause each character, number, symbol or command in the content to be spoken one at a time. In some implementations, prior to receiving the input, process 500 can output speech describing the virtual keyboard type (e.g., alphanumeric, numeric, foreign language). In some implementations, outputting speech corresponding to a key of the virtual keyboard can include outputting speech corresponding to a first key with a first voice pitch and outputting speech corresponding to a second key with a second voice pitch, where the first voice pitch is higher or lower than the second voice pitch.

Example Media Client Architecture

Figure 6:
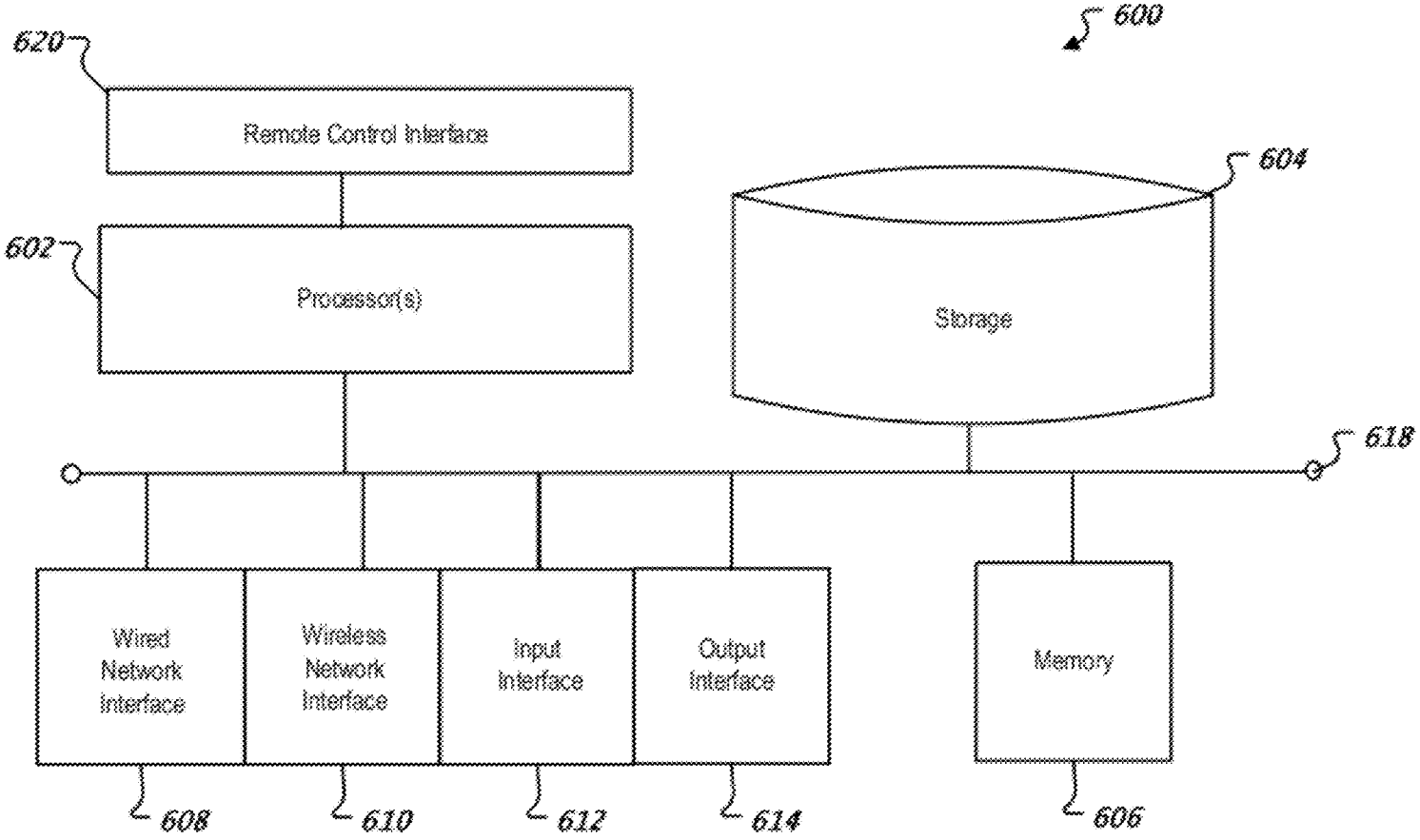
FIG. 6 is a block diagram of an exemplary digital media receiver for generating spoken interfaces.

FIG. 6 is a block diagram of an exemplary digital media receiver (DMR) 600 for generating spoken interfaces. DMR 600 can generally include one or more processors or processor cores 602, one or more computer-readable mediums (e.g., non-volatile storage device 604, volatile memory 606), wired network interface 608, wireless network interface 610, input interface 612, output interface 614 and remote control interface 620. Each of these components can communicate with one or more other components over communication channel 618, which can be, for example, a computer system bus including a memory address bus, data bus, and control bus. Receiver 600 can be a coupled to, or integrated with a media presentation system (e.g., a television), game console, computer, entertainment system, electronic tablet, set-top box. or any other device capable of receiving digital media.

In some implementations, processor(s) 602 can be configured to control the operation of receiver 600 by executing one or more instructions stored in computer-readable mediums 604, 606. For example, storage device 604 can be configured to store media content (e.g., movies, music), meta data (e.g., context information, content information), configuration data, user preferences, and operating system instructions. Storage device 604 can be any type of non-volatile storage, including a hard disk device or a solid-state drive. Storage device 610 can also store program code for one or more applications configured to present media content on a media presentation device (e.g., a television). Examples of programs include, a video player, a presentation application for presenting a slide show (e.g. music and photographs), etc. Storage device 604 can also store program code for one or more accessibility applications, such as a voice over framework or service and a speech synthesis engine for providing spoken interfaces using the voice over framework, as described in reference to FIGS. 1-5.

Wired network interface 608 (e.g., Ethernet port) and wireless network interface 610 (e.g., IEEE 802.11x compatible wireless transceiver) each can be configured to permit receiver 600 to transmit and receive information over a network, such as a local area network (LAN), wireless local area network (WLAN) or the Internet. Wireless network interface 610 can also be configured to permit direct peer-to-peer communication with other devices, such as an electronic tablet or other mobile device (e.g., a smart phone).

Input interface 612 can be configured to receive input from another device (e.g., a keyboard, game controller) through a direct wired connection, such as a USB, eSATA or an IEEE 1394 connection.

Output interface 614 can be configured to couple receiver 600 to one or more external devices, including a television, a monitor, an audio receiver, and one or more speakers. For example, output interface 614 can include one or more of an optical audio interface, an RCA connector interface, a component video interface, and a High-Definition Multimedia Interface (HDMI). Output interface 614 also can be configured to provide one signal, such as an audio stream, to a first device and another signal, such as a video stream, to a second device. Memory 606 can include non-volatile memory (e.g., ROM, flash) for storing configuration or settings data, operating system instructions, flags, counters, etc. In some implementations, memory 606 can include random access memory (RAM), which can be used to store media content received in receiver 600, such as during playback or pause. RAM can also store content information (e.g., metadata) and context information.

Receiver 600 can include remote control interface 620 that can be configured to receive commands from one or more remote control devices (e.g., device 112). Remote control interface 620 can receive the commands through a wireless connection, such as infrared or radio frequency signals. The received commands can be utilized, such as by processor(s) 602, to control media playback or to configure receiver 600. In some implementations, receiver 600 can be configured to receive commands from a user through a touch screen interface. Receiver 600 also can be configured to receive commands through one or more other input devices, including a keyboard, a keypad, a touch pad, a voice command system, and a mouse coupled to one or more ports of input interface 612.

The features described can be implemented in digital electronic circuitry, or in computer hardware, firmware, software, or in combinations of them. The features can be implemented in a computer program product tangibly embodied in an information carrier, e.g., in a machine-readable storage device, for execution by a programmable processor; and method steps can be performed by a programmable processor executing a program of instructions to perform functions of the described implementations by operating on input data and generating output. Alternatively or in addition, the program instructions can be encoded on a propagated signal that is an artificially generated signal, e.g., a machine-generated electrical, optical, or electromagnetic signal that is generated to encode information for transmission to suitable receiver apparatus for execution by a programmable processor.

The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language (e.g., Objective-C, Java), including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors or cores, of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network. The relationship of client and server arises by virtue of computer programs running on the respective computers and having a client-server relationship to each other.

One or more features or steps of the disclosed embodiments can be implemented using an Application Programming Interface (API). An API can define on or more parameters that are passed between a calling application and other software code (e.g., an operating system, library routine, function) that provides a service, that provides data, or that performs an operation or a computation.

The API can be implemented as one or more calls in program code that send or receive one or more parameters through a parameter list or other structure based on a call convention defined in an API specification document. A parameter can be a constant, a key, a data structure, an object, an object class, a variable, a data type, a pointer, an array, a list, or another call. API calls and parameters can be implemented in any programming language. The programming language can define the vocabulary and calling convention that a programmer will employ to access functions supporting the API.

In some implementations, an API call can report to an application the capabilities of a device running the application, such as input capability, output capability, processing capability, power capability, communications capability, etc.

A number of implementations have been described. Nevertheless, it will be understood that various modifications may be made. In addition, other steps may be provided, or steps may be eliminated, from the described flows, and other components may be added to, or removed from, the described systems. Accordingly, other implementations are within the scope of the following claims.

What is claimed is:

1. A method comprising:

causing a graphical user interface to be displayed by a media presentation system;

identifying navigable and non-navigable information presented on the graphical user interface;

converting the navigable and non-navigable information into speech; and while displaying the graphical user interface including the navigable information and the non-navigable information, determining whether a user input is received:

in accordance with a determination that the user input is received and that the user input selects the navigable information, outputting the speech corresponding to the navigable information; and in accordance with a determination that the user input is not received, outputting the speech corresponding to the non-navigable information after the non-navigable information has been displayed for a time period, where the method is performed by one or more computer processors.

2. The method of claim 1, further comprising:

identifying information that has been spoken and information that has not been spoken; and outputting speech corresponding to information that has not been spoken.

3. The method of claim 1, further comprising:

outputting speech corresponding to a first portion of information with a first pitch and outputting speech corresponding to a second portion of information with a second pitch that is higher or lower than the first pitch.

4. The method of claim 1, where outputting the speech corresponding to the navigable information comprises:

speaking a screen label for the graphical user interface.

5. The method of claim 1, further comprising:

receiving input from a remote control device; and responsive to the input, repeating outputting the speech corresponding to the navigable information.

6. The method of claim 2, where identifying information that has not been spoken, further comprises:

monitoring a history of information displayed on the graphical user interface that has been spoken; and determining information that has not been spoken based on the history.

7. The method of claim 1, further comprising:

prior to causing the graphical user interface to be displayed:

displaying a setup graphical user interface on the media presentation system;

determining a length of time that the setup graphical user interface has been displayed; and upon determining that the length of time that the setup graphical user interface has been displayed exceeds a pre-determined length of time, outputting a voice prompt requesting entry of input from a remote control device to cause the graphical user interface to be displayed.

8. The method of claim 1, where the speech is outputted in a voice pitch that varies based on the information type.

9. A system comprising:

one or more processors;

memory coupled to the one or more processors and storing instructions, which, when executed by the one or more processors, causes the cone or more processors to perform operations comprising:

causing a graphical user interface to be displayed by a media presentation system;

identifying navigable and non-navigable information presented on the graphical user interface;

converting the navigable and non-navigable information into speech; and while displaying the graphical user interface including the navigable information and the non-navigable information, determining whether a user input is received:

in accordance with a determination that the user input is received and that the user input selects the navigable information, outputting the speech corresponding to the navigable information; and in accordance with a determination that that user input is not received, outputting the speech corresponding to the non-navigable information after the non-navigable information has been displayed for a time period.

10. The system of claim 9, further comprising instructions for:

identifying information that has been spoken and information that has not been spoken; and outputting speech corresponding to information that has not been spoken.

11. The system of claim 9, further comprising instructions for:

outputting a first portion of information with a first pitch and a second portion of information with a second pitch that is different than the first pitch.

12. The system of claim 9, where outputting the speech corresponding to the navigable information comprises:

speaking a screen label for the graphical user interface.

13. The system of claim 9, further comprising instructions for:

receiving input from a remote control device; and responsive to the input, repeating outputting the speech corresponding to the navigable information.

14. The system of claim 10, where identifying information that has not been spoken, further comprises:

monitoring a history of information displayed on the graphical user interface that has been spoken; and determining information that has not been spoken based on the history.

15. The system of claim 9, further comprising instructions for:

displaying a setup graphical user interface on the media presentation system;

determining a length of time that the setup graphical user interface has been displayed and upon determining that the length of time that the setup graphical user interface has been displayed exceeds a pre-determined length of time, outputting a voice prompt requesting entry of input from a remote control device to cause the graphical user interface to be displayed.

16. The system of claim 9, where the speech is outputted in a voice pitch that varies based on a characteristic of the information.

17. The method of claim 1, wherein the non-navigable information cannot be selected.

18. The method of claim 17, wherein the non-navigable information cannot be selected by a screen pointer operated by a selection device.

19. The method of claim 1, wherein the navigable information can be focused on using a cursor, and wherein the non-navigable information cannot be focused on using a cursor.

20. A non-transitory computer readable medium storing one or more programs, which, when executed by one or more processors, cause the one or more processors to:

cause a graphical user interface to be displayed by a media presentation system;

identify navigable and non-navigable information presented on the graphical user interface;

convert the navigable and non-navigable information into speech; and while displaying the graphical user interface including the navigable information and the non-navigable information, determine whether a user input is received:

in accordance with a determination that the user input is received and that the user input selects the navigable information, output the speech corresponding to the navigable information; and in accordance with a determination that the user input is not received, output the speech corresponding to the non-navigable information after the non-navigable information has been displayed for a time period.

21. The non-transitory computer readable medium of claim 20, wherein the one or more programs, which, when executed by one or more processors, further cause the one or more processors to:

identify information that has been spoken and information that has not been spoken; and output speech corresponding to information that has not been spoken.

22. The non-transitory computer readable medium of claim 20, wherein the one or more programs, which, when executed by one or more processors, further cause the one or more processors to output speech corresponding to a first portion of information with a first pitch and outputting speech corresponding to a second portion of information with a second pitch that is higher or lower than the first pitch.

23. The non-transitory computer readable medium of claim 20, wherein outputting the speech corresponding to the navigable information comprises speaking a screen label for the graphical user interface.

24. The non-transitory computer readable medium of claim 20, wherein the one or more programs, which, when executed by one or more processors, further cause the one or more processors to:

receive input from a remote control device; and responsive to the input, repeat outputting the speech corresponding to the navigable information.

25. The non-transitory computer readable medium of claim 21, wherein identifying information that has not been spoken, further comprises:

monitoring a history of information displayed on the graphical user interface that has been spoken; and determining information that has not been spoken based on the history.

26. The non-transitory computer readable medium of claim 20, wherein the one or more programs, which, when executed by one or more processors, further cause the one or more processors to:

prior to causing the graphical user interface to be displayed:

display a setup graphical user interface on the media presentation system;

determine a length of time that the setup graphical user interface has been displayed; and upon determining that the length of time that the setup graphical user interface has been displayed exceeds a pre-determined length of time, output a voice prompt requesting entry of input from a remote control device to cause the graphical user interface to be displayed.

27. The non-transitory computer readable medium of claim 20, wherein the speech is outputted in a voice pitch that varies based on the information type.

* * * * *